United States Patent [19]

Carlsson

[11] 4,351,461

[45] Sep. 28, 1982

[54] METHOD AND AN ARRANGEMENT FOR THE FEED OF A MATERIAL WEB

[75] Inventor: Lars Carlsson, Blentarp, Sweden

[73] Assignee: Tetra Pak International AB, Lund, Sweden

[21] Appl. No.: 213,470

[22] Filed: Dec. 5, 1980

[30] Foreign Application Priority Data

Dec. 11, 1979 [SE] Sweden ..... 7910167

[51] Int. Cl.[3] ..... B65H 23/18; G03B 1/18

[52] U.S. Cl. ..... 226/28; 226/52

[58] Field of Search ..... 226/52, 53, 54, 55, 226/57, 58, 59, 93, 94, 2, 6, 27, 28, 29

[56] References Cited

U.S. PATENT DOCUMENTS

| | | | |
|---|---|---|---|
| 2,620,205 | 12/1952 | Vogt | 226/28 |
| 3,294,301 | 12/1966 | Richter | 226/27 |
| 3,673,418 | 6/1972 | Wiig | 226/27 |
| 4,081,944 | 4/1978 | Sjostrand | 226/28 |

*Primary Examiner*—Edward J. McCarthy

*Attorney, Agent, or Firm*—Burns, Doane, Swecker & Mathis

[57] ABSTRACT

A rotary driver feeds a web containing transverse crease lines. The driver contains circumferentially spaced edges which drivingly engage the crease lines. When the crease lines are spaced farther apart than the edges, that part of the web disposed between those edges is deflected inwardly, as by a vacuum, to bring the crease lines into engagement with the edges.

6 Claims, 1 Drawing Figure

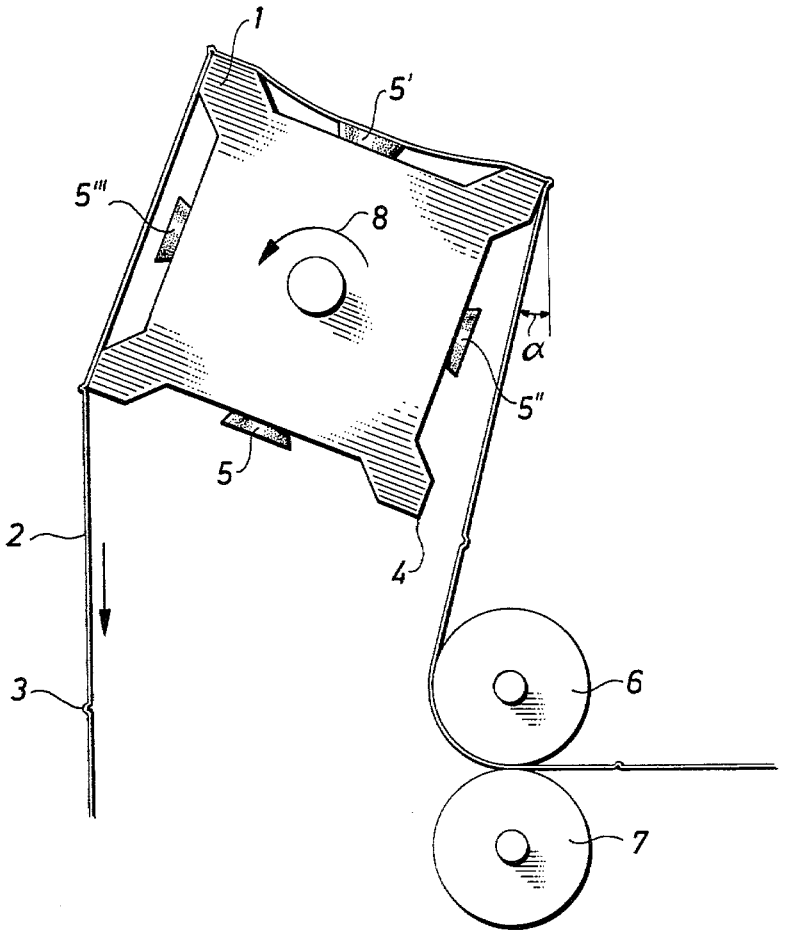
1
5'
5'''
8
α
5''
5
2
4
3
6
7

METHOD AND AN ARRANGEMENT FOR THE FEED OF A MATERIAL WEB

BACKGROUND AND OBJECTS OF THE INVENTION

The present invention relates to a method for the feeding of a material web provided with transverse crease lines with the help of a rotating driver which engages with the crease lines by means of edges arranged around its circumference.

The present invention relates also to an arrangement for the feed of a material web provided with transverse crease lines by means of a rotating driver which has axial edges distributed around its circumference adapted to engage with the crease lines.

Packages of a variety of different types are often manufactured from a semi-rigid plastic, paper or cardboard material which is supplied to an automatic machine and, while being fed stepwise through the machine is successively converted into a finished package. In the manufacture of packing containers e.g. for liquid foodstuffs, such as milk and the like, the machine is supplied with a weblike, laminated material. The material is relatively rigid, but flexible, and comprises a central carrier layer of paper which is coated at least on one side with a homogeneous plastic layer. To facilitate the folding of the material necessary for the conversion to finished packing containers, the material web is provided with a regularly recurring pattern of weakened or crease lines, along which the folding of the material will afterwards take place. The feed of the material occurs intermittently or continuously, but at varying speed according to a predetermined cycle in rhythm with the conversion of the web to individual packing containers. It is a prerequisite for the processing of the material web and conversion of the the same into individual packing containers that the material web must always be fed to an exactly predetermined position wherein the processing or the shaping is carried out, since otherwise the folding of the material will not take place along the crease lines mentioned earlier. An accurately defined length of feed which guides the material to a correct position is important also for other reasons, e.g. in the cases when the material is to be provided with opening arrangements or with a printed pattern which has to be placed so that it will be in correct position on the finished packing container.

The feed of a material web provided with crease lines, patterns or other irregularities in the aforementioned manner is called feed in register, and occurs very often in package manufacture. The most common method for ensuring a sufficiently accurate keeping in register is to provide the material web with a repeated pattern of photocell marks, e.g. printed dots or lines of contrasting colour, which pattern is in an accurately defined relation to the crease line pattern, print pattern or the like of the material web. With the help of photocells co-operating with the said photocell marks the feed, which may take place with the help of driver elements in the form of rollers, feed jaws or the like, is then monitored and continuously corrected so that a good synchronous feed is achieved and maintained. Such a correcting system also has the advantage that any inaccuracies in the crease line pattern, that is to say small deviations from the specified nominal dimension between transverse crease lines following upon each other exercize no negative effect. However, the system is complicated in its setup, and consequently also contains possible sources of error. It is a further disadvantage that the accuracy of the synchronization will depend directly on the accuracy with which the photocell marks are applied to the material web (in relation to the crease line pattern).

It is an object of the present invention to overcome the aforementioned disadvantages and to provide a method for the feeding of a material web provided with transverse crease lines in register, which method is simple and uncomplicated and renders unnecessary special marks on the material web made for keeping in register.

It is a further object of the present invention to provide a method of feed which automatically ensures that the feed takes place in register independently of the faults which may exist in the distance between transverse crease lines of the material web.

These and other objects have been achieved in accordance with the invention in that a method of the type described in the introduction has been given the characteristic that the linear distance between two crease lines intended for engagement with the driver is reduced through temporary bending of the material web situated between, so that each of the crease lines engages with its edge.

Preferred embodiments of the method in accordance with the invention have been given moreover the characteristics which are evident from subsidiary claims 2 and 3.

It is also an object of the present invention to provide an arrangement for the feed of a material web provided with transverse crease lines in register which arrangement is not affected by the previous disadvantages.

It is a further object of the present invention to provide a feed arrangement which is simple and uncomplicated and which by direct mechanical engagement with the transverse crease lines of the material web fed ensures that the feed is taking place in register with the crease line pattern, independently of the deviations which occur in the nominal distance between consecutive transverse crease lines.

BRIEF SUMMARY OF THE INVENTION

These and other objects have been achieved in accordance with the invention in that an arrangement of the type described in the introduction has been given the characteristic that the distance between two consecutive edges on the driver is smaller than the corresponding distance between crease lines of the material web, with elements being arranged so as to bend the part of the material web situated between the edges to such an extent that the crease lines coincide with the edges.

The method and the arrangement in accordance with the invention make it possible, directly in connection with the feed and with the help of the actual feed element, to overcome the effect of a faulty distance between consecutive transverse crease lines on the web so that the web never comes out of register. By designing the driver so that the distance between two consecutive edges is always smaller than the smallest accepted distance between the transverse crease lines co-operating with the driver on the material web which is to be used, and by shortening the linear distance between the crease lines co-operating with the said edges by bending in connection with the feed, the said crease lines are always fixed straight before the corresponding edges on the driver, so that the latter on rotating a certain predetermined part of a turn always displaces the web to a predetermined position, whereupon the cycle is repeated.

THE DRAWING

The method and the arrangement in accordance with the invention will be described in greater detail in the following with special reference to the enclosed schematic drawing which is a side elevation of the arrangement in accordance with the invention and only shows the details necessary for the understanding of the invention.

DETAILED DESCRIPTION OF PREFERRED EMBODIMENTS OF THE INVENTION

In the FIGURE is shown a feed element in the form of a rotating driver 1 which is mounted on a horizontal center axle. The driver 1 can be actuated by a motor and is installed in a packing machine (not shown) for the feed of a packing material web 2 which is to be processed in the machine. The packing material web consists of a laminated material which comprises a central carrier layer of paper, coated on both sides with homogeneous plastic material. The packing material web 2 is thus relatively rigid and in order to facilitate the necessary folding of the material web when converting the material web to packing containers, the material web is provided with a pattern of folding or crease lines, which comprise linear indentations in the material. Beside longitudinal crease lines and those extending obliquely across the material web, not shown on the drawing, the material web has transverse crease lines 3 extending transversely over the material web at equal intervals, which in accordance with the invention are also made use of for the feed of the web.

The rotating driver 1 is of a substantially square cross-section and has four mutually parallel edges 4 which are arranged at an equal pitch around the driver. Between the edges 4 the driver sides are recessed, and in each recess one or more pneumatic suction heads 5 are provided.

At some distance from the driver 1 a cylindrical guide roller 6 is provided which can rotate about a horizontal axle. The guide roller 6 is situated below the driver and extends slightly inwards underneath the same so that the part of the material web 2 which runs from the guide roller 6 to the driver 1 will always be between the driver and the vertical plane extending through the edge 4 towards which the web runs at the current instant, that is to say the angle $\alpha$ in the figure is always greater than 0.

A further cylindrical roller 7, whose centre axle is parallel with the guide roller 6, is in contact with the guide roller 6. The roller 7 can be braked by means of some adjustable electrical or mechanical device and the material web 3 running in the nip between the rollers 6 and 7 can be braked thereby, so that it is kept taut whilst running from the guide roller 6 to the current edge 4 of the driver. The remaining part of the material web 2, that is to say the part extending over the driver and the part which already has passed the driver is kept taut with the help of another device (not shown), e.g. a driving roller which can be rotated by means of an adjustable motor.

The driving of the material web in register with the help of the method and arrangement in accordance with the invention takes place by stepwise rotation of the driver 1 in the direction of the arrow 8. The material web 2 follows this rotation, because it enwraps such a large part of the circumference of the driver 1, that always at least two of the edges 4 of the driver engage with the crease lines 3 extending transversely over the material web 2, and this prevents any sliding of the material web in relation to the driver. On the assumption that the material web running over the driver is kept taut and that the distance between two adjoining edges 4 on the driver corresponds exactly to the distance between two transverse crease lines 3 following one another on the material web, the feed of the material web can be accurately controlled by the driver, since the rotation of the latter over a predetermined number of degrees corresponds to the feed of the material web over a predetermined length. However, it is not possible to provide the material web 2 with crease lines 3 with such precision that the distance between the crease lines following one another is exactly the same length over the whole length of the material web 2. Since even a very small fault in the distance between the crease lines following upon each other will gradually accumulate and together with earlier faults will cause the engagement between the crease lines and the edges 4 to be lost, and eventually the material web to come out of register, it is necessary that during each feed such a correction is performed that the effect of the faulty distance on the feed is eliminated. This is achieved in accordance with the invention by reducing the linear distance between two crease lines 3 intended for engagement with the driver 1 by means of temporary bending of the material web situated between lines until each of the crease lines engages with its edge 4 on the driver. When determining the distance between two edges 4 on the driver situated next to each other, it is necessary first to determine the greatest possible deviation from the nominal distance between two consecutive crease lines on the material web which can be tolerated in the manufacture of the material. The driver is then designed so that the distance between two consecutive edges is a little smaller than the corresponding distance between crease lines 3 of the material web, when these are at the shortest distance from each other which is accepted in the manufacture of the material. When the material web is fed with the help of the driver 1 the linear distance between the crease lines 3 is then reduced, in that the part of the material web situated between the edges 4, through the effect of a vacuum from the suction heads 5 is drawn down into the recess in the driver until the crease lines 3 engage with the respective edge 4. In this manner the part of the web situated between the crease lines 3 is centered in relation to the side of the driver situated between the edges 4, so that the crease line 3 which last has come into contact with the driver is brought into the correct position over the respective edge 4, and by repeating this procedure during each feed, the material is placed each time into a defined position. Variations in the distance between two consecutively situated crease lines 3 are without importance, since the bending of a web part each time brings about the locating of a new crease line in correct position over one of the edges of the driver. The bending of the material web may be done either by mechanical influence, e.g. by means of a mechanical gripping element, or by pneumatic effect, where pressure as well as vacuum may be used.

In accordance with a preferred embodiment of the arrangement in accordance with the invention the device which is adapted to bend the part of the material web situated between edges consists of suction heads 5 which are situated in the recessed areas in the driver 1. The suction heads are situated centrally between edges 4 of the driver situated adjoining each other. Each driver side appropriately has such a number of suction heads 5 arranged in line that the whole width of the material web is covered. Each suction head 5 comprises a flexible collar or sleeve which makes it posible to draw the material web down into the recess to such an extent that the current crease lines 3 engage with the respective edges 4.

The vacuum for the suction heads 5 is conducted to the driver 1 via connections (not shown) at the ends of the driver and supplied selectively to the suction heads as a function of the angular position of the driver. This is achieved by means of a stationary duct arranged at the end of the driver which extends around the center axle over an angle which corresponds to the upper part of the rotational turn of the driver, so that the suction heads are coupled to the vacuum source via connections terminating at the end of the driver while they are in their upper position. In the position shown in the figure, for example, the suction head 5' is active while the other suction heads are inactive. The suction head 5''' has just been inactivated and the suction head 5'' will shortly be activated on continued turning of the driver.

As can be seen from the drawing, the suction heads are situated at such a depth in the areas recessed in the sides of the driver that the material web which extends in a straight line between two consecutive edges 4, does not come into contact with the respective suction head. According to a preferred embodiment the material web is brought into contact with the suction head with the help of a movable counter device which depresses the material web in the space between the edges 4 until the suction head can retain the material web. This arrangement is of a well-known type and consists of a compression roller or cylinder (not shown on the drawing) which is acted upon by means of a spring in the direction towards the center axle of the driver element 1. The device is placed appropriately at some distance above the guide roller 6.

It is also possible, instead of using the spring-loaded counter device, to arrange the suction heads 5 so that they are movable between a front position, wherein they project outside the plane in which two edges 4 adjoining one another are situated, and a rear position, wherein they are drawn into the recessed area situated between the edges 4. Such a mechanism may be driven mechanically during the rotation of the driver or via the vacuum, and is to be preferred, especially in cases where the driver unit has to be fitted in a place where room is limited.

The driver shown in the figure has four edges, but it is also conceivable to design the driver with a different number of edges, e.g. three. The number of edges as well as the form and length naturally must be adapted to the material web which is to be fed.

During practical work with the apparatus of the invention it may happen that the distance between the crease lines on the web differs somewhat from the distance expected. In such cases the arrangement according to the invention enables a corresponding minor adjustment to be made of the web-length between the cooperating edges of the mandrel by simply adjusting the degree of vacuum to the suctions cups. Thus, a stronger vacuum will deform the rim of the suction cup to a higher extent and draw the web part in question deeper down in the recess of the rotatable driver so that the distance for the web part running between adjacent edges in practice is lengthened. However, the vacuum applied must of course never result in such a strong force that the crease lines of the web are forced to pass the correct position over the edges, i.e. the force caused by the vacuum should not be stronger than the total opposite force imparted to the web among other things by the engagement between the edge of the driver and the crease line.

In order to increase the possibility for the suction cups both to reach the web in the initial step and to draw the web down when the vacuum is applied it may also be advantageous to give the rim of each vacuum-cup a comparatively great height so that its outermost part reaches the imaginary plane between two adjacent edges of the driver, and to give the rim a bellowlike shape in order to ensure a maximum range and flexibility.

A rotatable driver with less edges than four, preferably three edges, may be favourable where the crease lines in the web are vague and indefinite and for the use together with a thin and very flexible laminated web, which has a tendency to fold also in areas where no crease lines are provided.

I claim:

1. A method for feeding a web containing transverse crease lines in which a rotary driver contains edges spaced around its periphery which are arranged to drivingly engage the crease lines, the improvement comprising the step of temporarily bending that part of the web disposed between two of said edges to urge the respective crease lines into engagement with said two edges.

2. A method according to claim 1, wherein a vacuum is temporarily applied to said part of said web to bend the latter.

3. A method according to claim 2, wherein the vacuum is applied during only a portion of the rotary angle of said driver.

4. In an apparatus for feeding a web containing transverse crease lines, said apparatus including a rotary driver which contains edges spaced around its periphery for drivingly engaging the crease lines, the improvement wherein the distance between two consecutive ones of said edges is less than the distance between consecutive crease lines, and means arranged to temporarily bend that part of the web disposed between two of said edges by an amount sufficient to make said crease lines coincide with said two edges.

5. Apparatus according to claim 4, wherein those portions of said driver situated between adjacent edges are recessed relative to a plane containing said adjacent edges.

6. Apparatus according to claim 5, wherein suction heads are situated in said recesses for imparting forces to the web for temporarily bending same.

* * * * *